United States Patent [19]

Maddock

[11] 4,170,192

[45] Oct. 9, 1979

[54] APPARATUS FOR SUPPLYING FLUID MEDIA TO THE INTERNAL SURFACE OF A TUBULAR WORKPIECE

[76] Inventor: Paul T. Maddock, 1614-13 St. North, Lethbridge, Alberta, Canada

[21] Appl. No.: 760,755

[22] Filed: Jan. 19, 1977

[30] Foreign Application Priority Data

Apr. 22, 1976 [GB] United Kingdom ..... 16365/76

[51] Int. Cl.[2] ..... B05C 7/02

[52] U.S. Cl. ..... 118/306; 118/DIG. 10

[58] Field of Search ..... 118/306, DIG. 10; 427/236

[56] References Cited

U.S. PATENT DOCUMENTS

| | | | |
|---|---|---|---|
| 1,839,891 | 1/1932 | Perkins | 118/306 |
| 2,017,042 | 10/1935 | Dougherty | 118/306 X |
| 2,461,517 | 2/1949 | Carnevale | 118/306 |
| 2,792,807 | 5/1957 | Cummings | 118/DIG. 10 UX |
| 3,078,823 | 2/1963 | Cummings et al. | 118/DIG. 10 UX |
| 3,135,629 | 6/1964 | McLean | 118/DIG. 10 UX |
| 3,359,943 | 12/1967 | Briggs et al. | 118/306 |
| 3,895,604 | 7/1975 | Ryan | 118/DIG. 10 X |

FOREIGN PATENT DOCUMENTS

| | | | |
|---|---|---|---|
| 244158 | 3/1970 | U.S.S.R. | 118/306 |

*Primary Examiner*—Robert Mackey

*Attorney, Agent, or Firm*—Blanchard, Flynn, Thiel, Boutell & Tanis

[57] ABSTRACT

Apparatus for supplying fluid for use at the internal surface of a tubular workpiece is provided with a housing mounted in a frame which is movable along the inside of the workpiece. A plurality of rigidly connected, coaxially arranged fluid supply pipes are rotatably mounted in the housing and project from one end of the housing. Fluids are supplied to the housing through a plurality of non-rotatable supply pipes, pass through conduits provided by the interior of the inner rotatable supply pipe and by the annular section clearances between radially adjacent rotatable supply pipes, and are discharged through outlet conduits which are connected respectively to the projecting ends of the individual rotatable fluid supply pipes and which are supported at their ends at the outer end of a radial arm carried by the projecting ends of the rotatable fluid supply pipes.

Rotary seals mounted in the housing engage the inlet ends of the rotatable fluid supply pipes and the inlet ends of these pipes of progressively increasing diameter are disposed progressively downstream of the inlet of the inner rotatable fluid supply pipe so as to reduce the volume enclosed by the conduits provided by these pipes and so as to reduce the average size of the rotary seals.

8 Claims, 5 Drawing Figures

APPARATUS FOR SUPPLYING FLUID MEDIA TO THE INTERNAL SURFACE OF A TUBULAR WORKPIECE

BACKGROUND OF THE INVENTION

The invention relates to fluid supply apparatus for supplying fluid media for use at the internal surface of a tubular workpiece.

In the manufacture of metal pipe, it is often necessary to treat the internal surface of the pipe with a fluid medium; for example, with a jet of air containing sand particles, for sand blasting, or with a jet of air containing finely divided globules of paint, for paint spraying; and so it is necessary to pass the discharge end of a conduit for the fluid medium along a helical path over the internal surface of the pipe so as to direct a jet of the fluid medium onto the internal surface. Similarly, to perform mechanical operations on the internal surface of a tubular workpiece, such as a metal pipe, by means of fluid driven tools such as pneumatic grinding wheels, or to heat the internal surface of the pipe by means of a gaseous medium which is passed over a heater or which is formed by mixing two different gaseous media for combustion in a combustion heater, it is necessary to pass the discharge end of a conduit for the gaseous medium along a helical path over the internal surface of the pipe and into a mechanical tool which is driven by the fluid medium, or into a heater.

In the past, apparatus of this kind has been constructed so that rotation has been effected as a result of the reaction of a tangential component of the fluid medium discharging from the appartus. However, in this case, the speed of rotation was dependent upon the pressure and rate of flow of the fluid medium. Thus, it was not possible to vary the speed of rotation without varying the pressure and rate of flow of the fluid so that it was impossible to maintain this pressure and rate of flow at optimum values.

This deficiency has, to some extent, been overcome by providing the apparatus with a rotatable nozzle and drive means for positively rotating the nozzle at a speed independent of the pressure and rate of flow of the fluid fed to the nozzle. An apparatus such as this is described in U.S. Pat. No. 3,071,107.

However, in apparatus such as this, the rotatable nozzle is fed from a single rotatable supply pipe so that material in addition to a first fluid fed through the rotatable supply pipe; for example, sand or paint particles entrained in a stream of air or a mixture of oxygen and acetylene or oxygen and some other combustible gas; must be mixed prior to entry to the rotatable supply pipe and this can cause difficulty.

For example, where a combustible gaseous mixture is to be burned in a heater, prior mixing of the components of the combustible mixture results in a safety hazard which could be overcome by feeding the two gaseous components separately to the burner. Similarly, entrainment of liquid particles in a jet of a gaseous medium; for example, in spray painting where globules of paint are suspended in a jet of air; may be effected more efficiently if the liquid and the gaseous media are mixed immediately prior to their application to the internal surface of the tubular workpiece. One way of avoiding this pre-mixing in the application of a liquid spray to the internal surface of a tubular workpiece is to pressurize the liquid so that "atomization" is effected without the use of an air jet, as in "airless spraying". Unfortunately, this "airless spraying" technique involves the disadvantage that when starting and stopping, while the pressure of the liquid is less than that required to effect "atomization" of the liquid, the liquid runs from the nozzle in an uncontrolled manner. It is therefore necessary to provide the nozzle with valve means to prevent the escape of liquid at a pressure less than that required to convert the liquid into a spray. This is most effectively done by means of a fluid operated mechanism for controlling the valve, but this mechanism is most effectively controlled by means of a separate fluid supply line. Similar considerations apply in respect of other fluid driven tools, in that control may be conveniently effected by means of fluid responsive means requiring an additional fluid supply line. This also applies when a synthetic resin such as epoxy resin or a polyurethane is to be applied to the internal surface of a tubular workpiece, together with an activator or hardener. If these constituents are mixed prior to application, there is a chance that the resin will solidify within the apparatus, particularly during temporary stoppages of the apparatus. In cases such as this, it is preferable to provide the constituents in the form of pressurised liquids which are fed independently to separate nozzles where they are airlessly sprayed into a common atomized jet where particles of the constituents combine and react on settling on the internal surface of the tubular workpiece.

One form of apparatus suitable for applying two or more fluid constituents to the internal surface of a tubular workpiece is described in U.S. Pat. No. 1,839,891. In apparatus such as this, drive means are provided for rotating an assembly of coaxially nested tubular members of equal length which are connected at their ends for rotation in unison. A first fluid medium is fed axially through the inner tubular member and different fluids are fed to annular cross-section spaces between radially adjacent tubular members through radial pipes which extend from openings in the surface of the outer tubular member. These openings are arranged for rotation in chambers enclosed by sleeves disposed around the outer tubular member. These sleeves are respectively provided with seals at their opposite ends for engagement with the outer tubular member on opposite sides of the chambers around the openings of the radial pipes. The outlets from the inner tubular member and from annular cross-section spaces between radially adjacent tubular members are communicatively connected to radially extending pipes so that, on rotation of the device, fluid material discharging from the open ends of these radial pipes is applied to the internal surface of a tubular workpiece. In apparatus such as this, each annular cross-section space disposed between radially adjacent tubular members extends throughout the whole length of the assembly of coaxially nested tubular members and so there are relatively large volumes of fluids in each of these spaces which remain stagnant and which cannot be flushed from the apparatus by cleaning fluids passed through the apparatus, as is necessary when dealing with liquids such as paint which can solidify if the apparatus is allowed to stand without operating. These pockets of stagnant fluid also constitute a safety hazard when formed of inflammable gas or vapour, because of the possibility of leakage.

Another disadvantage of the hereinbefore described apparatus is that sealing of the annular cross-section spaces between radially adjacent coaxially nested tubular members is effected by the seals between the outer sleeves and the outer tubular member so that the leakage can occur around the whole circumference of this, the largest tubular member in the assembly of coaxially nested tubular members.

SUMMARY OF THE INVENTION

It is an object of the present invention to provide fluid supply apparatus in which the disadvantages common to known forms of apparatus for supplying gaseous media for use at the internal surface of a tubular workpiece are reduced in that pockets of stagnant fluid are avoided and leakage of fluid is more effectively prevented.

According to the invention, there is provided a fluid supply apparatus, for supplying fluid media for use at the internal surface of a tubular workpiece, comprising a frame which is movable along the inside of the tubular workpiece, a housing mounted within the frame, at least two rigidly connected, coaxially arranged fluid supply pipes mounted for rotation within the housing, with the inlet ends of the rotatable supply pipes of progressively increasing diameter disposed progressively downstream of the inlet end of the inner rotatable supply pipe, rotary seals carried by the housing and respectively engaging the inlet ends of the rotatable supply pipes to isolate chambers between the seals engaging the inlet ends of radially adjacent rotatable supply pipes from each other, driving means for rotating the rotatable supply pipes in unison, a plurality of non-rotatable supply conduits respectively connected to the housing for communicative connection to the inlet end of the inner rotatable supply pipe and to said chambers disposed between the seals engaging the inlet ends of radially adjacent rotatable supply pipes, a plurality of branch conduits respectively communicatively connected to the rotatable supply pipes, and support means for supporting the outlets of the branch conduits adjacent the internal surface of the tubular workpiece.

In one form of the invention, where fluid is supplied to a fluid controlled appliance; for example, where one or more liquids are "airlessly sprayed" from a nozzle; the appliance, such as the nozzle means carried by the support means, is provided with a control device, such as a fluid controlled valve which is controlled by fluid within one of the branch conduits connected to the nozzle means.

The frame in which the housing of the apparatus is mounted is preferably provided with bearers which are engageable with opposite sides of the internal periphery of the tubular workpiece and is preferably adjustable for engagement of the bearers with the internal peripheries of tubular workpieces of different diameters. Thus, in preferred embodiments of the invention, the frame comprises at least two tong mechanisms which are pivotally connected to each other and extend symmetrically on opposite sides of a radial plane through the rotational axis of the rotatable fluid supply pipes and means engageable with at least one of the tong mechanisms are provided for articulating intersecting members of the tong mechanisms so as to vary the width of the frame transversely of the rotational axis of the rotatable supply pipes.

Conveniently, each tong mechanism comprises two intersecting pairs of tong members and a cross member about which the tong members of each pair are pivotable, at the opposite ends of said cross member, and the pivotally connected tong mechanisms are connected by two further cross members about the opposite ends of which the adjacent ends of the tong members of the two tong mechanisms, on each side of the frame, are pivotally mounted. The housing within which the rotatable supply pipes are rotatably mounted may then be supported by one of the two further cross members and a non-rotatable supply conduit extending coaxially of the axis of the rotatable fluid supply pipes and communicatively connected to one end of the housing for supply of fluid to the inner supply pipe may be mounted for sliding movement through a slider bearing supported by the second of said two further cross members.

In a preferred embodiment of the invention, the non-rotatable supply conduit is formed with an external screw thread and a nut engaging this screw thread can be moved along the non-rotatable supply conduit into abutment with the slider bearing so as to vary the distance between the two said further cross members and thus vary the distance transversely of the rotational axis of the rotatable fluid supply pipes between the free ends of the tong mechanisms.

BRIEF DESCRIPTION OF THE DRAWINGS

Preferred embodiments of the invention are now described with reference to the accompanying drawings, in which.

DESCRIPTION OF PREFERRED EMBODIMENTS

Figure 1:
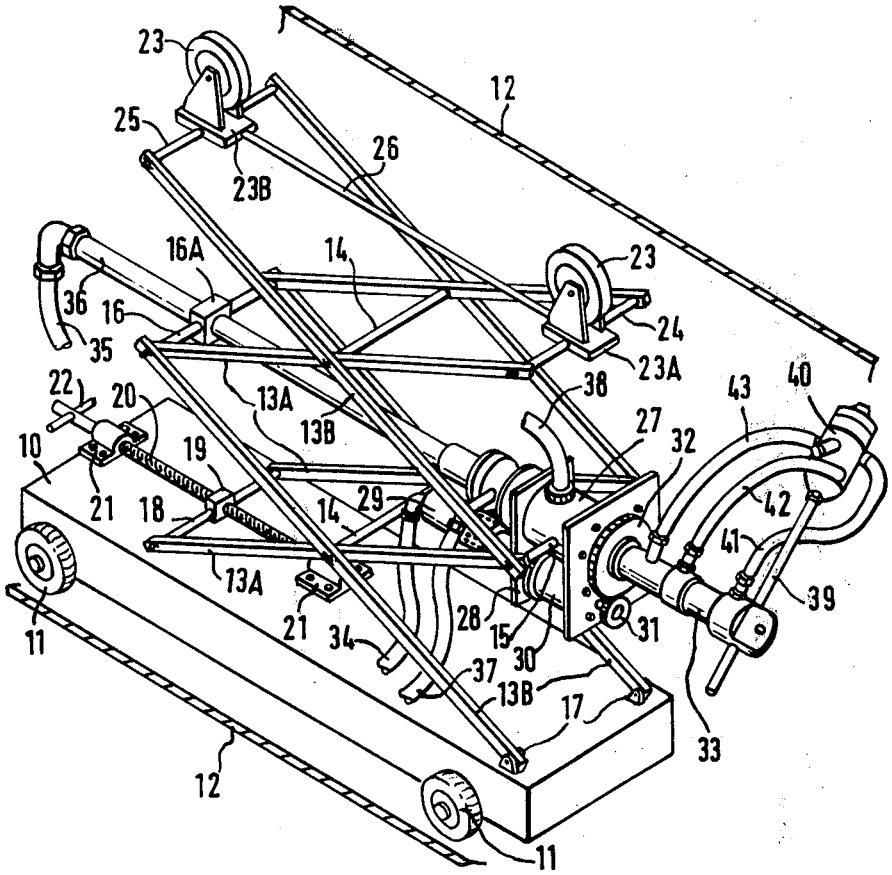
FIG. 1 is a perspective view of a paint spraying apparatus according to the invention in which a jet of air is used to atomise a stream of paint.

As shown in FIG. 1, a trolley 10 provided with four wheels 11 (only two of which are shown) supports two tong mechanisms which, together with the trolley 10 form a frame which is movable along the inside of a tubular workpiece 12. Each tong mechanism comprises two pairs of tong members 13A and 13B and these pairs are respectively pivotable about opposite ends of a cross member 14. The tong mechanisms are pivotally connected by two further cross members 15 and 16 which, at their opposite ends, carry the adjacent ends of the tong members 13A of one tong mechanism and the adjacent ends of the tong members 13B of the other tong mechanism.

The ends of the tong members 13B of one of the tong mechanisms are pivotally supported in brackets 17 attached to the trolley 10 and the ends of the other tong members 13A of the same tong mechanism are interconnected by a cross member 18 which carries a screw-threaded sleeve 19. A screw-threaded spindle 20 supported for rotation in brackets 21, attached to the trolley 10, is rotatable by means of a handle 22 to cause articulation between the two tong mechanisms. Two further wheels 23, which are carried by cross members 24 and 25 extending, respectively, between the free ends of the tong members 13A and the free ends of the tong members 13B of the other tong mechanism, are therefore moved perpendicularly of the trolley 10 for engagement with the upper portion of the inner periphery of the tubular workpiece 12. Thus, by suitable choice of the diameters of the wheels 11 and 23, it can be ensured that the cross members 15 and 16 are always disposed at the mid-height of a workpiece 12 engaged on its internal periphery by the wheels 11 and 23. To stiffen the frame, a rod 26 extends from a base 23A supporting one of the wheels 23 and through an aperture formed in a base 23B supporting the other wheel 23 so that the base 23B is able to slide along the rod 26.

A housing 27 is supported on the cross member 15 and flange plates 28 support an air motor 29, a reduction drive 30 and a pinion 31 which meshes with a gear wheel 32 carried on a rotatable supply pipe assembly 33 mounted for rotation in the housing 27.

Air for the air motor 29 is supplied through air hose 34, air for atomizing the paint, to form the paint spray, is supplied through hose 35 to one end of a rigid, non-rotatable supply pipe 36 which is connected to the housing 27. Control air is supplied through hose 37 and paint is supplied through hose 38. As shown, the rigid, non-rotatable supply pipe 36 passes through a slider-block 16A which is carried by the cross member 16 and is free to slide along the pipe 36 as the frame is adjusted so as to move the wheels 23 towards or away from the wheels 11.

An arm 39 which is clamped in a diametrically extending hole formed in the free end of the supply pipe assembly 33 carries an air atomising paint spraying nozzle 40 at its free end and hoses 41, 42 and 43 extending from the supply pipe assembly 33 to the nozzle 40 respectively supply atomizing air, control air and paint to the nozzle 40, the control air effecting actuation of valve means (not shown) disposed within the nozzle 40.

In an alternative arrangement, where actuation of the valve means is effected electrically, current may be passed to the nozzle 40 by way of a carbon brush sliding on a slip ring mounted on the supply pipe assembly 33. This form of construction is particularly suitable for an apparatus in which the air motor 29 is replaced with an electric motor.

Figure 2:
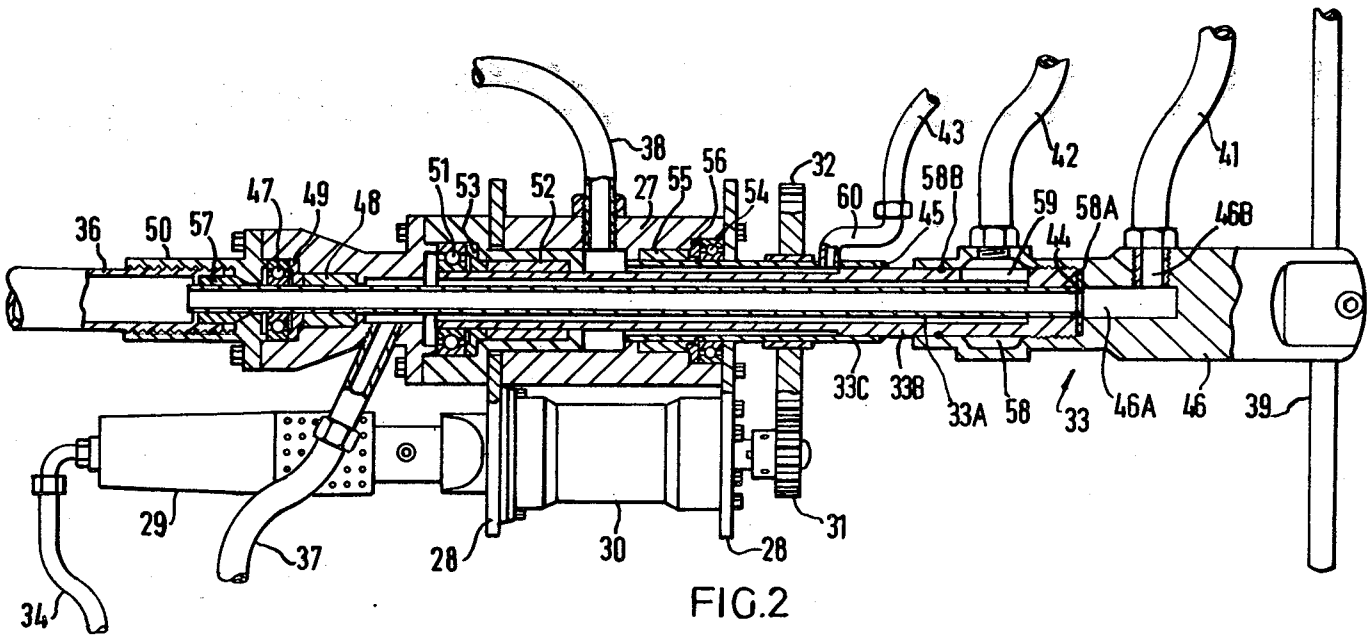
FIG. 2 is a sectional view of part of the apparatus shown in FIG. 1.

As shown in FIG. 2, the supply pipe assembly 33 consists of an inner pipe 33A, a coaxially disposed intermediate pipe 33B and a coaxially disposed outer pipe 33C. Inner and outer pipes 33A and 33C are respectively welded to pipe 33B by means of welds 44 and 45 and pipe 33B is screw-threaded for attachment to a closure member 46 carrying the arm 39. The inner pipe 33A extends right through the housing 27 and, at its inlet end, is supported for rotation relative to the housing 27 by means of a ball bearing 47 and sealed by a rotary seal 48, the seal 48 being locked in place by means of a gland sleeve 49 which bears against the bearing 47. The bearing 47 is held in place by an attachment sleeve 50 which is secured to the housing 27 by means of screws. Similarly, the inlet end of the tube 33B is supported for rotation within the housing 27 by means of a roller bearing 51 and is sealed by a rotary seal 52 which is held in place by means of a gland sleeve 53 which is pressed towards the seal 52 by means of the bearing 51, the bearing 51 being held in place by means of a detachable portion of the housing which is held in place by screws. The inlet end of the outer pipe 33C is supported for rotation within the housing 27 by means of a roller bearing 54 and is sealed by means of a rotary seal 55 which is held in place by means of a gland sleeve 56 disposed between the bearing 54 and the seal 55. The bearing 54 is held in place by means of the flange plate 28 which is attached to the housing 27 by screws. An additional seal 57 is mounted on the outer end of the inner pipe 33A which projects beyond the bearing 47 into the attachment sleeve 50. As shown in FIG. 2, the internal surface of the attachment sleeve 50 is screw-threaded for engagement with a screw-thread formed on the end of the supply pipe 36 and this supply pipe 36 is provided with an inwardly directed, annular abutment which, on screw-threaded engagement of the supply pipe 36 with the attachment sleeve 50, presses the seal 57 against a tapered opening formed in the end of the attachment sleeve 50 which abuts the remainder of the housing 27.

Atomizing air in the non-rotatable supply pipe 36 flows through the inner pipe 33A and into an axial passage 46A formed in the closure member 46, and then radially through a passage 46B to a nipple to which the hose 41 is attached. Hose 42, for the control air, is also attached to a nipple formed on the closure member 46. In this case, the nipple extends from an annular-section chamber 58 extending around a portion of the pipe 33B formed with an aperture 59, the chamber 58 being sealed by rubber washers 58A and 58B fitted between the pipe 33B and an enclosing sleeve forming part of the closure member 46. Hose 43, for the paint, is attached to an outlet pipe 60 extending from an aperture formed in the outer supply pipe 33C.

Thus, as the air motor 29 is driven by air supplied through hose 34, the supply pipe assembly 33 is driven through the reduction gear 30, a pinion 31 and the meshing gear wheel 32. Atomizing air flows through the inner pipe 33A and is prevented from leaking by seals 48 and 57 at the inlet end of this pipe and by means of the rubber washer 58A disposed between the welded ends of the pipes 33A and 33B and the closure member 46. Control air, for effecting operation of the valve means of the paint spraying nozzle 40 is fed through hose 37 into a chamber disposed between the seals 48 and 52 and flows through the annular passage between the pipes 33A and 33B to the hose 42. Paint is fed through hose 38 into a chamber disposed between the seals 52 and 55 and flows through the annular passage between pipes 33B and 33C to the hose 43.

In operation, as the nozzle 40 rotates around the interior of the tubular workpiece 12, to spray-paint the interior surface of the tubular workpiece 12, the trolley 10 is moved along the pipe from right to left, as shown in FIG. 1. This movement of the trolley 10 is conveniently effected by pulling on a line (not shown) attached to the trolley 10. Alternatively, the trolley may be fitted with a driving motor (not shown) such as an air motor or an electric motor.

It is also to be understood that the air motor 29 may be driven by air supplied from the hose 37 supplying the control air to the housing 27. Alternatively, the air motor 29 may be replaced by another form of motor, such as an electric motor.

Figure 3:
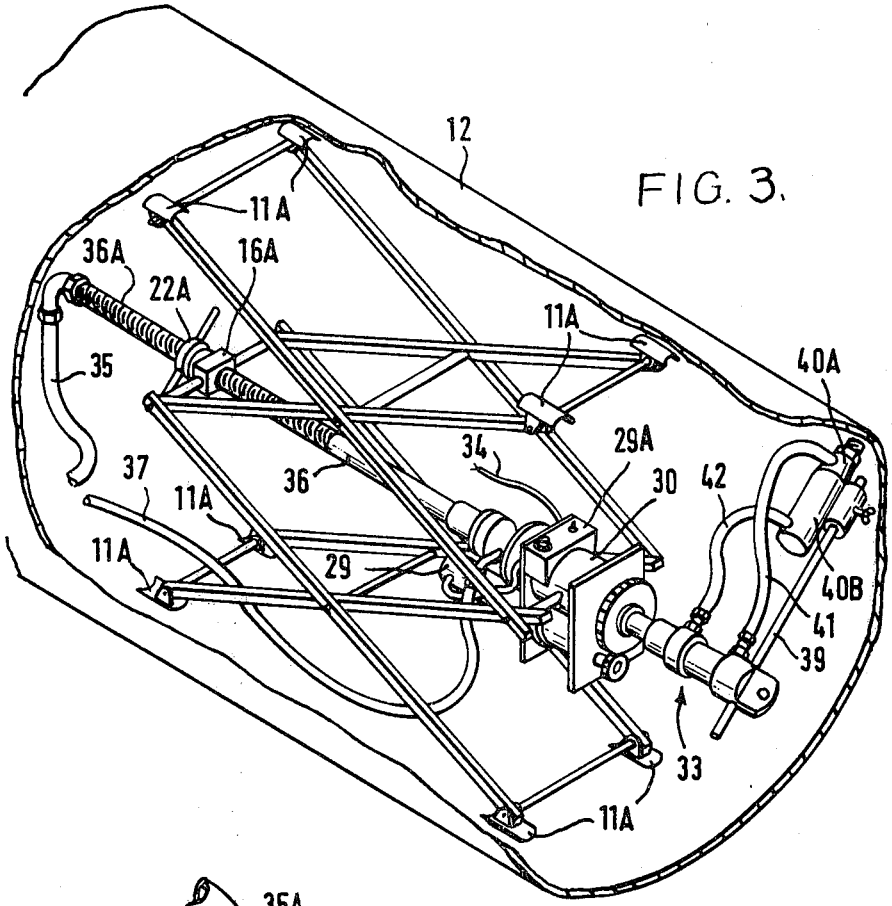
FIG. 3 is a perspective view of an airless paint spraying apparatus embodying the invention.

In the modified form of fluid supply apparatus shown in FIG. 3, the wheels 11 and 23 are replaced by skids 11A which are attached to the outer extremities of the tong mechanisms forming the frame. In this case, articulation of the tong mechanisms is effected by rotation of a nut 22A on a screw-thread 36A formed at one end of the non-rotatable supply pipe 36. The nut 22A abuts against the slider block 16A to prevent the frame from collapsing under its own weight.

In the apparatus illustrated in FIG. 3, the nozzle 40A is an airless paint spraying nozzle which receives paint at high pressure which is supplied through hose 35, the inner rotatable supply pipe of the supply pipe assembly 33 and hose 41 and control air, for actuating valve means 40B, for controlling the nozzle 40A, is supplied through hose 37, the annular passage between the inner and outer rotatable supply pipes of the supply pipe assembly 33 and hose 42. In this embodiment, movement of the apparatus along the pipe 12 is effected by dragging the apparatus with a line attached to the frame, from right to left as shown in FIG. 3.

In an alternative method of operation, the skids 11A are spread apart so as to be locked in place within the pipe 12. The apparatus can thus be secured in place even when the pipe 12 is inclined or vertical.

In addition to the use of the apparatus shown in FIG. 3 for airless paint spraying, the nozzle 40A can be replaced by a gas cutting torch or a preheating gas burner which is co-operable with the valve means 40B. For different applications, the rotational speed at which the supply pipe assembly 33 is driven by the air motor 29 is controlled by means of a control box 29A mounted on the housing 30.

Figure 4:
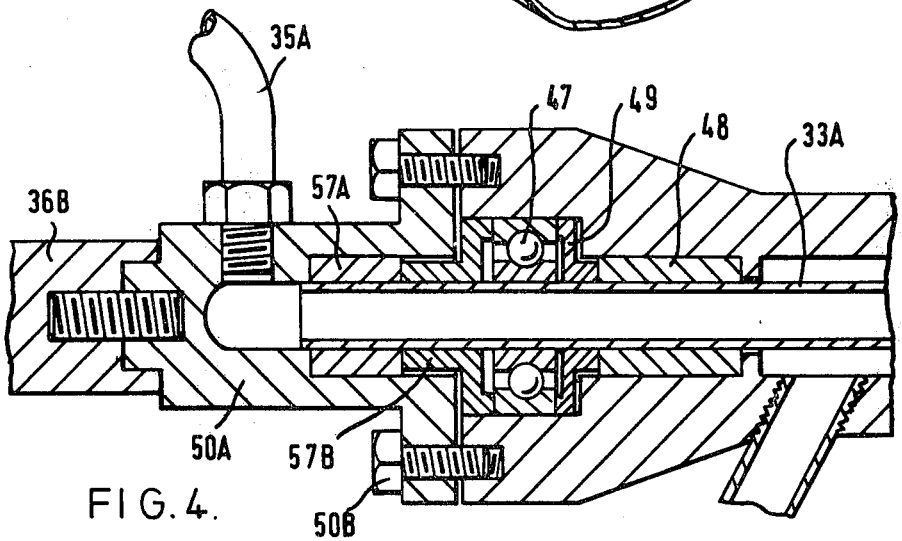
FIG. 4 is a sectional view of part of a modified form of the apparatus shown in FIGS. 1 to 3.

According to the modification shown in FIG. 4, the non-rotatable supply pipes 36 of the embodiments illustrated in FIGS. 1 and 3 are replaced by a solid, non-rotatable rod 36B (only partly shown) which is connected to an attachment sleeve 50A and a hose 35A is connected to a radial aperture in the attachment sleeve 50A. According to this modification, screws 50B can be used to compress seal 57A more effectively than the seal 37 of the embodiment illustrated in FIGS. 1 and 2. Thus, by means of gland sleeves 57B and 49, seal 48 is also more effectively compressed.

Clearly, the rod 36B can be provided with an external screw-thread similar to the screw-thread 36A on the supply pipe of the embodiment illustrated in FIG. 3. Externally screw-thread rods are readily available for this purpose.

In one form of construction of apparatus according to the invention, the trolley 10 may be driven by an air motor 61 (FIG. 5) which is driven in opposite directions by compressed air fed through hose 62A and 62B which are connected to the motor 61 so that air from these hoses causes the motor to rotate in opposite directions. Both hoses 62A and 62B pass through a shut-off valve 63 which controls the flow of air through hose 62A, but not through hose 62B. This air flowing through the hose 62A causes the motor 61 to drive the trolley from left to right, as shown in FIG. 5, by means of a reduction drive 64, a high gear chain and sprocket transmission 65A and driven wheels 11 which are connected to the transmission 65A by means of a clutch 66A.

The clutch 66A is held in engagement by means of a piston-cylinder assembly 67 which is energised by compressed air fed through a hose 68A which branches from the hose 62A, downstream of the shut-off valve 63. The trolley 10 is therefore driven down the pipe 12, from left to right, at a relatively high speed, until a sensor wheel 63A connected to the valve 63 rides over the right hand end of the pipe 12 and so causes the valve 63 to shut off the flow of compressed air through the hose 62A.

Figure 5:
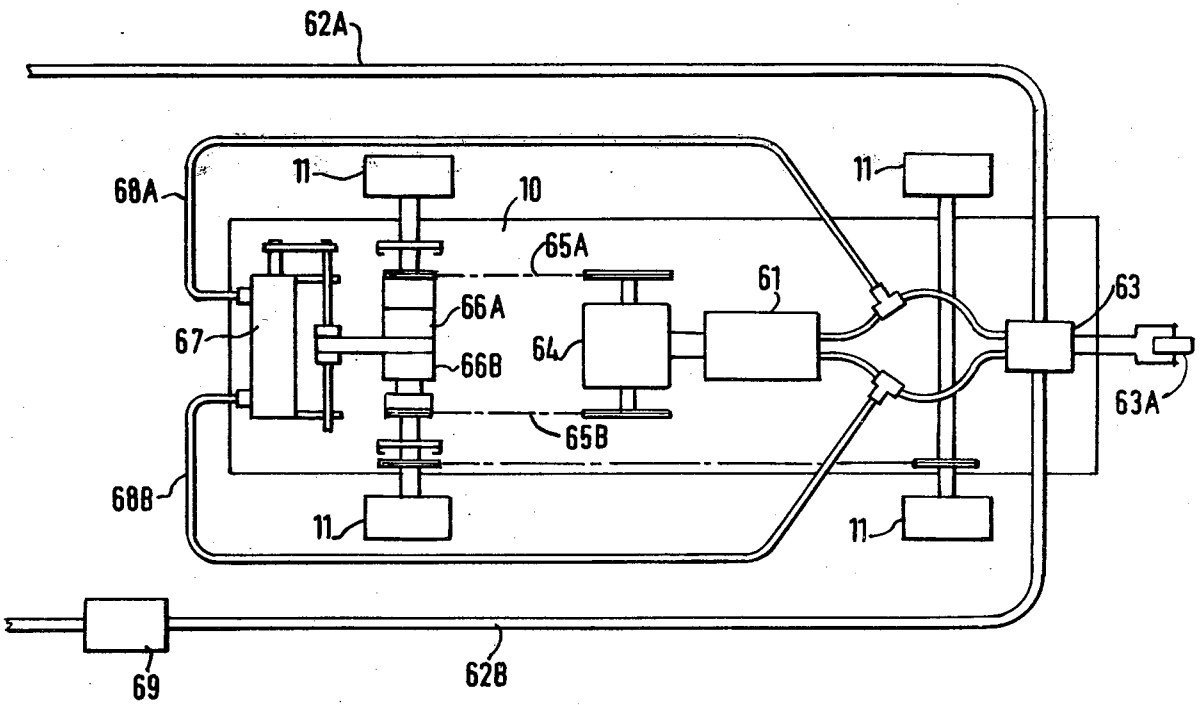
FIG. 5 is a plan view of a trolley for the apparatus.

When the hose 62B is then communicatively connected to a source of compressed air, this compressed air flows into the motor 61 and the piston-cylinder assembly 67 to drive the trolley 10 along the pipe 12, in the opposite direction, from right to left as shown in FIG. 5, at a lower speed. The reversal in direction of movement of the trolley is effected as a result of the passage of compressed air from the hose 62B passing through the motor 61 in the opposite direction to the compressed air from the hose 62A. The reduction in speed of the trolley is effected by operation of the piston-cylinder assembly 67 which is now supplied with compressed air through a hose 68B which is branched from the hose 62B downstream of the shut-off valve 63. This operation of the piston-cylinder assembly 67 causes disengagement of the clutch 66A and engagement of the clutch 66B so that the driven wheels 11 become connected to the reduction drive 64 by means of a low gear chain and sprocket transmission 65B.

Control means 69, connected to the hose 62B, are operable to control commencement of the supply of fluid media for use at the internal surface of the pipe 12; for example, in the operation of a paint spraying nozzle, in accorance with the invention. Although the control means 69 are shown connected to the hose 62B, for operation by compressed air within the hose 62B, the control means may be operable independently of the supply of compressed air through the hose 62B.

In an alternative form of construction either or both of the air motors 29 and 61 are replaced by hydraulic motors connected to hydraulic fluid lines. This can be advantageous in providing a more stable drive than is provided with an air motor.

I claim:

1. In a fluid supply apparatus for supplying fluid media for use at the internal surface of a tubular workpiece, the improvement comprising:

adjustable frame means which is movable along the inside of the tubular workpiece;

a tubular housing nonrotatably mounted on the frame means;

at least two rigidly connected coaxially arranged fluid supply pipes mounted for rotation within the housing and having open inlet ends and closed outlet ends, with the inlet ends of the rotatable supply pipes being of progressively increasing diameter as disposed progressively downstream of the inlet end of the inner rotatable supply pipe;

rotary seals carried by the housing and respectively engaging the inlet ends of the rotatable supply pipes to isolate a chamber between said radially adjacent rotatable supply pipes;

driving means which are wholly supported on the frame means for rotating the rotatable supply pipes in unison, said driving means including rotatable motor means and geared speed reducer means connected between said motor means and said supply pipes;

a plurality of nonrotatable supply conduits connected to the housing for respectively communicating with the inlet ends of the rotatable supply pipes adjacent said rotary seals;

a plurality of branch conduits respectively connected to the outlet ends of the rotatable supply pipes for communication through the inner supply pipe and said chamber with the supply conduits;

support means for supporting the outlets of the branch conduits adjacent the internal surface of the tubular workpiece;

mounting means provided on the frame means for engagement with the inside of the tubular workpiece to facilitate movement of the frame means along the inside of the workpiece;

said frame means comprising two tong mechanisms pivotally connected together in series;

said two tong mechanisms each having at least two pairs of intersecting tong members which are pivotally connected to each other at the intersection point and extend symmetrically on opposite sides of a radial plane through the rotational axis of the rotatable fluid supply pipes; and means engageable with at least one of the tong mechanisms for articulating the intersecting members of the tong mechanisms so as to vary the width of the frame means transversely of the rotational axis of the rotatable supply pipes.

2. Apparatus according to claim 1, in which each tong mechanism comprises said two pairs of intersecting tong members and a first cross member located at said intersection point about which the tong members of each pair are pivotable, and two further cross members are provided for pivotally mounting, about their opposite ends on each side of the frame means, the adjacent ends of the tong members of the two tong mechanisms, so as to pivotally connect said two tong mechanisms together.

3. Apparatus, according to claim 2, in which the housing is supported by one of the two further cross members; a slider bearing is supported by the second of the two further cross members; and one of the non-rotatable supply conduits extending coaxially of the axis of the rotatable fluid supply pipes and communicatively connected to one end of the housing for supply of fluid to the inner supply pipe is mounted for sliding movement through said slider bearing.

4. Apparatus, according to claim 3, in which the non-rotatable supply conduit extending coaxially of the axis of the rotatable fluid supply pipes is formed with an external screw-thread and a nut engaging this screw-thread can be moved along said non-rotatable supply conduit into abutment with the slider bearing so as to vary the distance between the two said further cross members and thus varies the distance transversely of the rotational axis of the rotatable fluid supply pipes between the free ends of the tong mechanisms.

5. Apparatus according to claim 3, including manually rotatable adjustment means disposed adjacent one longitudinal end of said apparatus and cooperating with said frame means for adjustably pivotally moving said tong mechanisms transversely to thereby simultaneously transversely displace said housing and the rotational axis of said rotatable supply pipes.

6. Apparatus, according to claim 1, in which the frame means includes a trolley; reversible drive means are mounted on the trolley; remote control means are connected to the drive means to control the speed and direction of movement of the trolley, and a limit switch for disabling the drive means is mounted on the trolley so as to stop movement of the trolley in one direction towards the end of a tubular workpiece when the trolley reaches said end of the workpiece.

7. In an apparatus movable along the interior of an elongated tubular workpiece for supplying and discharging fluid media against the internal surface of said workpiece, the improvement comprising:

adjustable frame means which is movable along the inside of said tubular workpiece in the longitudinal direction thereof, said frame means being adjustable transversely to accommodate workpieces of different cross-sectional dimensions;

said frame means including a pair of substantially identical scissor mechanisms which are pivotally connected in series transversely relative to said longitudinal direction, each scissor mechanism including at least two pairs of sidewardly displaced intersecting elongated elements which are pivotally connected at their points of intersection, said points of intersection being disposed intermediate the ends of said elongated elements, the elongated elements at their inner ends as associated with one scissor mechanism being pivotally connected to the inner ends of the elongated elements associated with the other scissor mechanism, and a pair of cross members connected to and extending between the pairs of elongated elements at the pivotally connected inner ends of said pair of scissor mechanisms;

nonrotatable tubular housing means fixedly secured to one of said cross members and projecting in the longitudinal direction of said workpiece;

at least two rigidly connected coaxially arranged fluid supply pipes mounted for rotation within said tubular housing means, said fluid supply pipes having open inlet ends and closed outlet ends, the latter ends projecting forwardly of said housing means;

rotary seal means cooperating between said housing means and said rotatable supply pipes to define a first fluid supply passage through the inner supply pipe and to define an annular fluid supply chamber defined between said housing and said inner supply pipe adjacent the inlet end of the outer supply pipe for permitting a fluid to be supplied through the latter;

drive means supported on said housing means for rotating said supply pipes in unison;

a plurality of nonrotatable supply conduits connected to said housing means for respectively communicating with the inlet ends of the rotatable supply pipes adjacent said rotary seal means;

a plurality of outlet conduits respectively connected to the outlet ends of the rotatable supply pipes for communication through the inner supply pipe and said chamber with the respective supply conduits;

support means disposed adjacent the internal surface of the tubular workpiece and fixedly connected to and rotatable with one of said supply pipes adjacent the outlet end thereof for supporting the outlet ends of said outlet conduits; and engaging means mounted on said frame means adjacent the outer ends of the elongated elements associated with said pair of scissor mechanisms for engagement with the inside of the tubular workpiece to facilitate movement of said frame means along the workpiece in the longitudinal direction thereof.

8. An apparatus according to claim 7, including manually rotatable adjustment means disposed adjacent one end of said frame means and cooperating with said scissor mechanisms for pivotally moving said scissor mechanisms to thereby transversely adjust the width of said frame means and thereby simultaneously transversely displace said housing means and the rotatable supply pipes mounted thereon in accordance with the size of said workpiece.

* * * * *